US006725496B2

(12) United States Patent
Chang

(10) Patent No.: US 6,725,496 B2
(45) Date of Patent: Apr. 27, 2004

(54) CLEANING BRUSH

(76) Inventor: Che-Yuan Chang, No. 1, Lane 147, Sec. 2, Chung San Rd. Yun Lin, Chang Hua Hsien (TW)

( * ) Notice: Subject to any disclaimer, the term of this patent is extended or adjusted under 35 U.S.C. 154(b) by 0 days.

(21) Appl. No.: 10/198,090

(22) Filed: Jul. 19, 2002

(65) Prior Publication Data

US 2003/0066151 A1 Apr. 10, 2003

(30) Foreign Application Priority Data

Oct. 8, 2001 (TW) ..... 90217081 U

(51) Int. Cl.[7] ..... A46B 9/10
(52) U.S. Cl. ..... 15/184
(58) Field of Search ..... 15/184

(56) References Cited

U.S. PATENT DOCUMENTS 1,054,229 A * 2/1913 Methven
1,701,961 A * 2/1929 Scully
2,674,001 A * 4/1954 Abrams
6,226,828 B1 * 5/2001 Lin

* cited by examiner

*Primary Examiner*—Randall Chin
(74) *Attorney, Agent, or Firm*—Browdy and Neimark, P.L.L.C.

(57) ABSTRACT

The present invention is to provide a cleaning brush comprising a handle, a movable seat and bristles. The handle has a guiding rail at center along the elongated direction thereof, a guiding slot, a button opening communicated with the guiding slot and two locking portions at opposite ends of the guiding slot respectively. The movable seat mounts the bristles at an end thereof and disposes an upper arm and a lower arm at the other end thereof. A driving button is disposed on the upper arm and has two locking members thereon. The movable seat is inserted into the guiding rail of the handle and the driving button is extended out of the handle via the button opening so that the movable seat can slide freely along the guiding rail of the handle within the guiding slot and the locking members of the movable seat are engaged with the locking portions of the handle when the driving button is moved to the opposite ends of the guiding slot respectively to lock the movable seat.

5 Claims, 3 Drawing Sheets

CLEANING BRUSH

FIELD OF THE INVENTION

The present invention relates generally to a cleaning tool, and more particular to a cleaning brush.

BACKGROUND OF THE INVENTION

FIG. 1 shows a conventional cleaning brush 1 which is a portable brush for brushing dust from small goods. The cleaning brush 1 has a handle 2, a movable seat 3 and bristles 4. The movable seat 3 is slidably received in the handle 2 and the bristles 4 are mounted at the front end of the movable seat 3. A pushing button 5 extends from the movable seat and is slidably disposed on the handle 2 for sliding the movable seat 3 in the handle 2. A user can push the pushing button 5 forwards to extend the bristles 4 out of the handle 2 and the user can also push the pushing button 5 backwards to make the bristles 4 move into the handle 2.

However, the conventional cleaning brush 1 does not provide any mechanism to lock the movable seat 2 when the bristles 4 located within the handle 2. Absent a lock mechanism, the bristles 4 can slide out when the user is carrying the cleaning brush 1 or can slide into the handle 2 when the brush is in use. Furthermore, it is hard to hold the handle 2 of the conventional cleaning brush 1 stably when in use.

SUMMARY OF THE INVENTION

The primary objective of the invention is to provide a cleaning brush, which can overcome the drawbacks as described above.

According to the objective of the invention, a cleaning brush comprises a handle, a movable seat and bristles. The handle has a guiding rail along its longitudinal length, a guiding slot, a button opening communicating with the guiding slot and two locking portions respectively located at opposite ends of the guiding slot. The movable seat mounts the bristles at an end thereof and disposes an upper arm and a lower arm at the other end thereof. A driving button is disposed on the upper arm and has two locking members thereon. The movable seat is inserted into the guiding rail of the handle with the driving button extending out of the handle via the button opening so that the movable seat can be slid freely along the guiding rail of the handle within the guiding slot and the locking members of the movable seat respectively engaged with the locking portions of the handle when the driving button is moved to a corresponding end of the guiding slot.

DETAIL DESCRIPTION OF THE INVENTION

Figure 1:
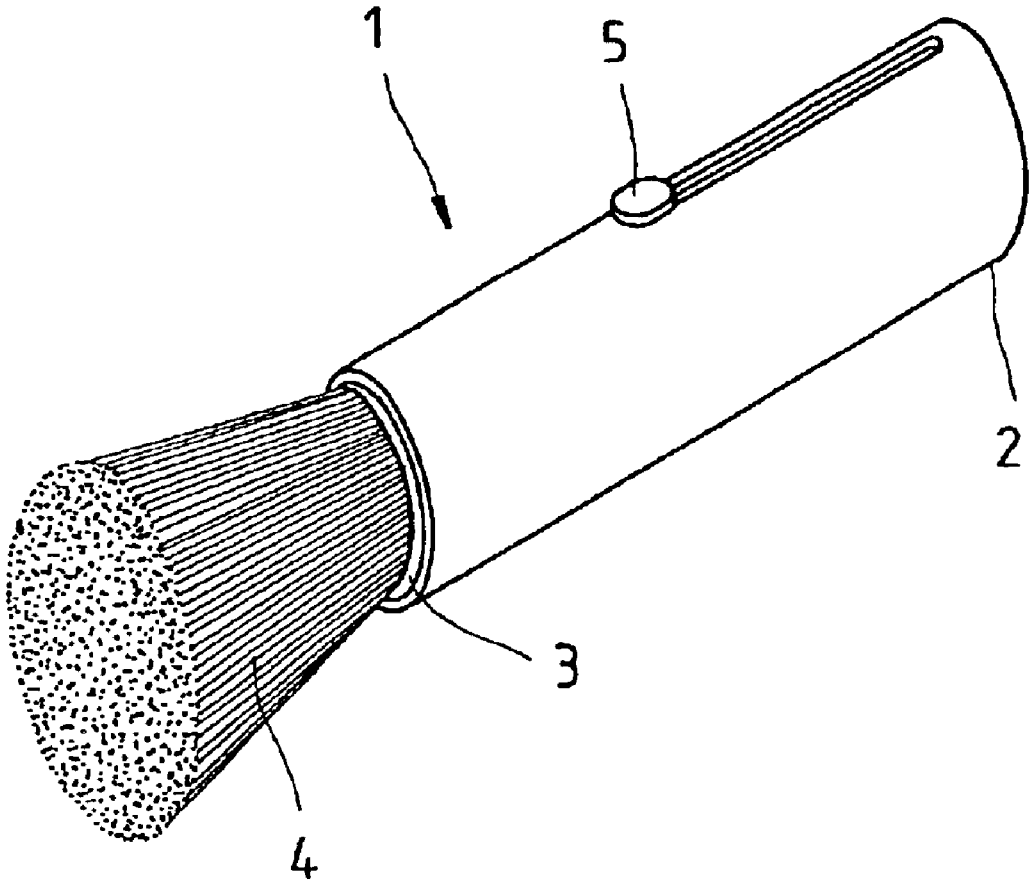
FIG. 1 PRIOR ART
FIG. 1 is a perspective view of a conventional cleaning brush.
Figure 2:
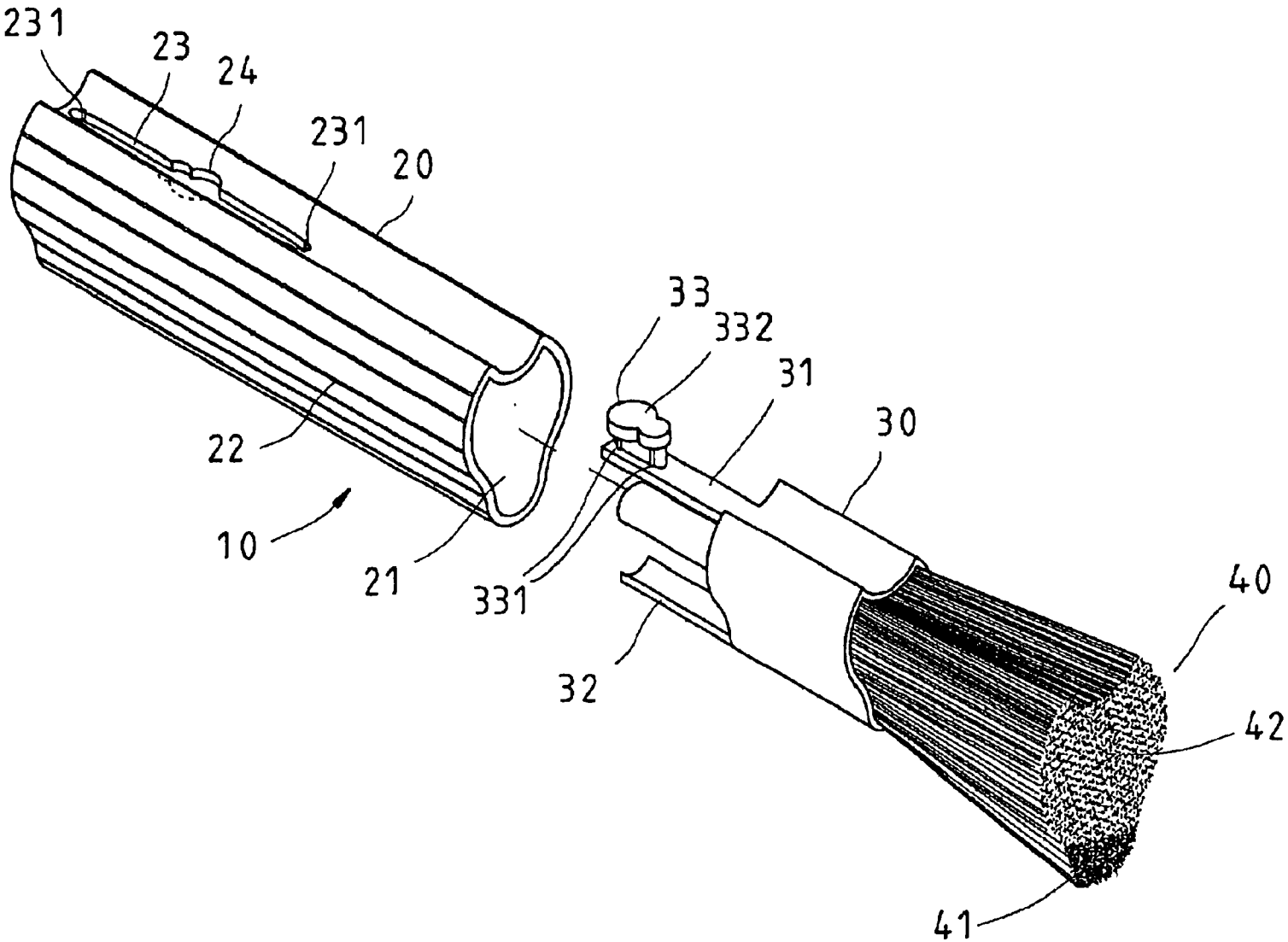
FIG. 2 is an exploded view of a preferred embodiment of the present invention.

Please refer to FIG. 2, the preferred embodiment of the present invention provides a cleansing brush 10, which mainly comprises a handle 20, a movable seat 30 and bristles 40.

The handle 10 is a tube element having a water-drop shape in cross section thereof. The handle 10 has a guiding rail 21 along the longitudinal length thereof, ribs 22 on the outer surface along the length thereof permitting the user to hold the handle stably, a guiding slot 23 along the longitudinal length thereof, a button opening 24 at midsection of the guiding slot 23 and two locking portions 231 at opposite ends of the guiding slot 23 respectively. The button opening 24 is constructed from a larger opening and a smaller opening communicating with each other.

The movable seat 30 mounts the bristles 40 at an end thereof and is provided with an upper guiding arm 31 and a lower guiding arm 32 at the other end thereof. A driving button 33 is disposed on the upper guiding arm 31 of the movable seat 30. The driving button 33 has a head portion 332 at top end thereof and two locking members 331, which are two parallel ribs, under the head portion 332. The head portion 332 is constructed from two round blocks corresponding in shape to the button opening 24 of the handle 20.

The movable seat 30 is inserted into the guiding rail 21 of the handle 20 at the end having the upper guiding arm 31 and the lower guiding arm 32. The head portion 332 of the driving button 33 is extended out of the handle 20 via the button opening 24 and serves to slide the movable seat 30 along the guiding rail 21 within the extension of the guiding slot 23 and will not escape from the handle 20. Thus, the user can operate the head portion 332 of the driving button 33 to move the movable seat 30.

The bristles 40 are constructed from hard bristles 41 and soft bristle 42 to make the cleaning brush 10 of the present invention can clean any smaller corner.

Figure 3:
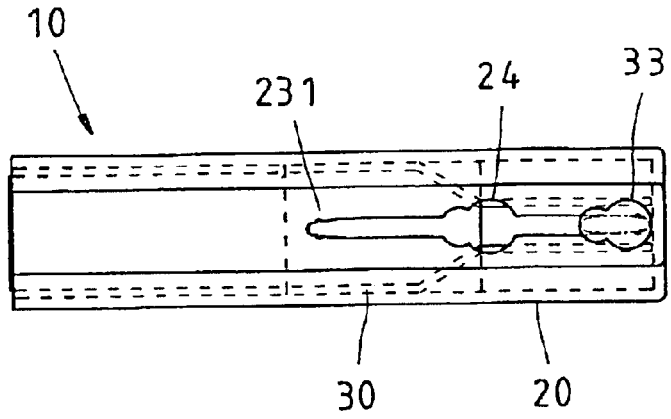
FIG. 3 is a top view of the preferred embodiment of the present invention, showing the bristles being received in the handle.
Figure 4:
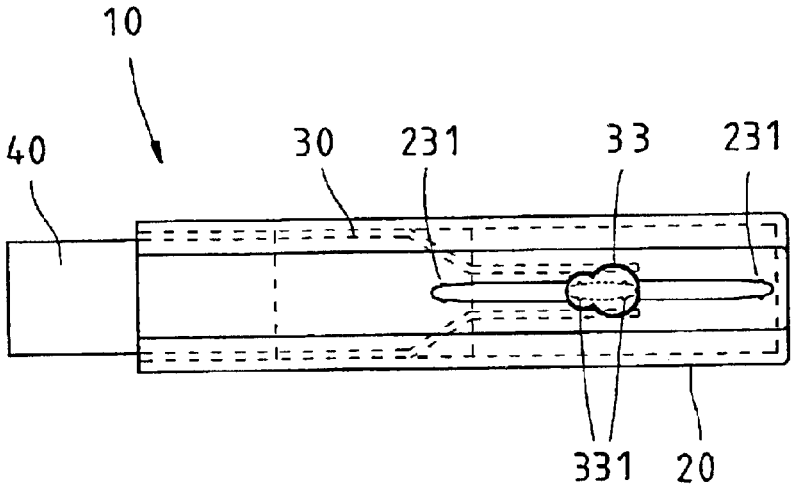
FIG. 4 is a top view following FIG. 3, showing the bristles extending out of the handle.
Figure 5:
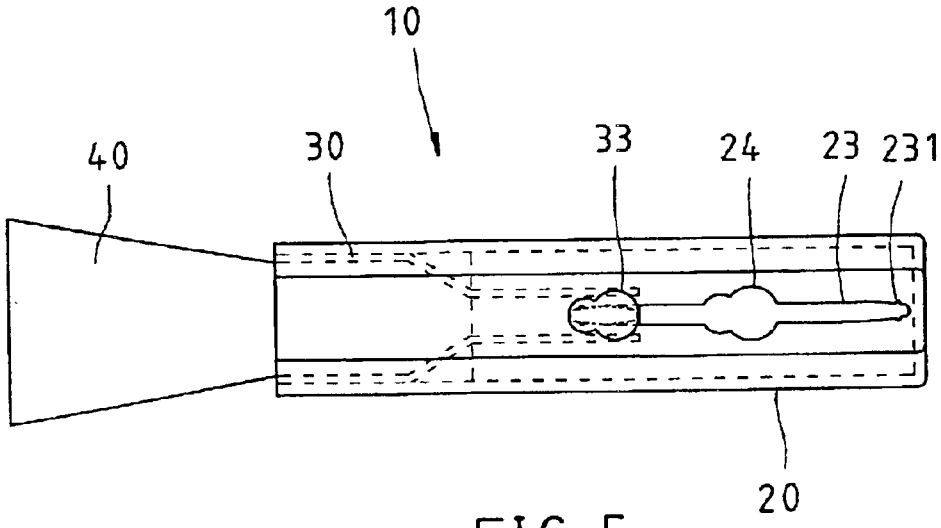
FIG. 5 is a top view following FIG. 4, showing the bristles being fully pushed out of the handle.

FIG. 3 shows the movable seat 30 moved to the rear end of the guiding slot 23, wherein the bristles 40 are totally received in the handle 20 and the locking member 331 at the rear side of the driving button 33 interferes with the locking portion 231 at rear end of the guiding slot 23 to lock the movable seat 30 in its stored position. Next, please refer to FIG. 4, which shows the movable seat 30 slid forward with the bristles 40 extending out of the handle 20. When the driving button 33 of the movable seat 30 is moved to the front end of the guiding slot 23, please refer to FIG. 5, the bristles 40 will totally extend out of the handle 20 and the locking member 331 at the front side of the driving button 33 is engaged in the locking portion 231 at front end of the guiding slot 23 to lock the movable seat 30 at position where bristles 40 can be used.

The advantages of the present invention are that the movable seat 30 can be locked both at a position for use and a stored position. The bristles 40 are fixed when they are moved out of the handle 20 to clean and stored in the handle 20 when moved into the handle. The handle 20 is a column with a water-drop shape in cross section and has the ribs 22 thereon, which permits the user to hold it stably.

What is claimed is:

1. A cleaning brush, comprising:

a handle having a guiding rail along a longitudinal length thereof, a guiding slot, a button opening communicating with said guiding slot and two locking portions respectively located at opposite ends of said guiding slot;

a movable seat having a first and second end and an upper arm and a lower arm on the first end; driving button on said upper arm; said driving button having two locking members thereon;

said movable seat inserted into said guiding rail of said handle with said driving button extending out of said handle through said button opening; wherein said movable seat can slide freely along said guiding rail of said handle within the guiding slot and said locking members of said movable seat can respectively engage said locking portions of said handle when said driving button is moved to a corresponding end of said guiding slot; and bristles mounted on said movable seat at the second end thereof to move with said movable seat.

2. The cleaning brush as defined in claim 1, wherein said bristles have hard bristles and soft bristles.

3. The cleaning brush as defined in claim 1, wherein said handle has a water-drop shape in cross section.

4. The cleaning brush as defined in claim 1, wherein said handle is provided with ribs on an outer surface thereof.

5. The cleaning brush as defined in claim 1, wherein said button opening of said handle is constructed from two openings communicating with each other and said driving button has a shape corresponding to said button opening.

* * * * *